US010351980B2

(12) United States Patent
Mantione

(10) Patent No.: US 10,351,980 B2
(45) Date of Patent: Jul. 16, 2019

(54) ADJUSTABLE KNITTING NEEDLE AND METHOD FOR KNITTING

(71) Applicant: Alexis Crafting Needles, LLC, Malverne, NY (US)

(72) Inventor: Alexis M. Mantione, Malverne, NY (US)

(73) Assignee: ALEXIS CRAFTING NEEDLE, LLC, Malverne, NY (US)

( * ) Notice: Subject to any disclaimer, the term of this patent is extended or adjusted under 35 U.S.C. 154(b) by 66 days.

(21) Appl. No.: 15/621,022

(22) Filed: Jun. 13, 2017

(65) Prior Publication Data

US 2018/0023227 A1 Jan. 25, 2018

Related U.S. Application Data

(60) Provisional application No. 62/364,141, filed on Jul. 19, 2016.

(51) Int. Cl.
*D04B 3/02* (2006.01)

(52) U.S. Cl.
CPC ..... *D04B 3/02* (2013.01)

(58) Field of Classification Search
CPC ..... D04B 3/02; D04B 3/00
USPC ..... 66/1 A, 117
See application file for complete search history.

(56) References Cited

U.S. PATENT DOCUMENTS 2,093,631 A * 9/1937 Burnham ..... D04B 3/02 66/117
2,309,528 A 1/1943 Otting
2,668,429 A * 2/1954 Barsky ..... D04B 3/02 66/117
3,280,595 A * 10/1966 Linstead ..... D04B 3/00 66/117
3,678,712 A * 7/1972 Singleton ..... D04B 3/00 223/102
4,007,610 A * 2/1977 Linstead ..... D04B 3/00 66/117
4,494,387 A * 1/1985 Phipps ..... D04B 3/02 66/117
4,553,410 A 11/1985 Okada
4,607,505 A * 8/1986 Dunker ..... D04B 3/02 66/1 A (Continued)

OTHER PUBLICATIONS

International Search Report and Written Opinion mailed in corresponding International Application PCT/US2017/037134 dated Aug. 14, 2017 (7 pages.).

*Primary Examiner* — Danny Worrell
(74) *Attorney, Agent, or Firm* — Wissing Miller LLP

(57) ABSTRACT

A knitting needle assembly has a needle body including a tip at one end and a cord connected to the needle body at other end. An adjustable slider is disposed on the cord. The cord stabilizes and holds stitches of yarn used to create a knitted workpiece. The distance between the needle tip and the slider can be adjusted by the user to accommodate the width of the knitted workpiece. Two such assemblies are used to knit. The sliders on each assembly can be adjusted to compress previously formed stitches of the workpiece so that the stitches are delivered to the needle body under a resiliency force. The sliders can also be adjusted to accommodate newly formed stitches without compression so they move freely away from the needle tip once they are formed.

20 Claims, 8 Drawing Sheets

(56) References Cited

U.S. PATENT DOCUMENTS

| | | | | |
|---|---|---|---|---|
| 4,646,543 | A * | 3/1987 | Okada | D04B 3/02 66/117 |
| 4,680,947 | A * | 7/1987 | Phipps, Sr. | D04B 3/02 66/117 |
| 4,693,094 | A * | 9/1987 | Kahn | D04B 3/02 66/117 |
| 5,720,187 | A | 2/1998 | Matuo | |
| 6,983,627 | B1 | 1/2006 | Eley-Holden-Sotnik | |
| 7,117,693 | B1 | 10/2006 | Nova | |
| 7,874,181 | B1 * | 1/2011 | Lindahl | D04B 3/02 66/117 |
| 7,954,342 | B2 | 6/2011 | Devagnanam | |
| 8,181,489 | B2 * | 5/2012 | Selter | D04B 3/02 66/117 |
| 8,210,003 | B2 | 7/2012 | Zheng | |
| 8,813,524 | B2 * | 8/2014 | Thompson | D04B 3/00 66/1 A |
| 9,181,641 | B1 * | 11/2015 | Moraca | D04B 3/02 |

* cited by examiner

ADJUSTABLE KNITTING NEEDLE AND METHOD FOR KNITTING

The present application claims priority under 35 U.S.C. § 119(e) to U.S. Provisional Application No. 62/364,141 filed on Jul. 19, 2016, which is incorporated herein by reference.

BACKGROUND

Field

The present disclosure relates to knitting needles with improved functionality. In particular, the present disclosure relates to a knitting needle that includes a cord with an adjustable stop for supporting a knitted workpiece as it is being created that holds the work securely while knitting. The present disclosure further relates to a method for using such knitting needles.

Description of the Related Art

Knitting needles allow a knitter to form yarn into fabric by creating a pattern of interlinked stitches of yarn that result in a fabric workpiece. While a workpiece is being knitted the stitches forming the leading edge of the fabric is held on one of the needles. A stitch from the leading edge of the workpiece is moved to the tip of the needle and linked with a loop of yarn, forming a new stitch of the subsequent row of the workpiece. That newly created stitch is transferred to the other needle. The process is repeated until a complete new row of stitches is formed and the workpiece is transferred entirely from one needle to the other needle. The leading edge of the workpiece is now formed by the new row of stitches. The knitter then creates another new row of stitches by joining stitches to the leading edge of the workpiece and transferring those stitches back to the first needle. The length of the workpiece is not limited because the knitter can continually add rows to the workpiece.

Known knitting needles may, however, limit the width of the workpiece. As the knitter stitches a row, the row must be stored on the needle itself. If a stitch were to become disengaged from the supporting needle before it is linked with a stitch on the subsequent row the stitch would unravel, potentially ruining the workpiece. Thus, the workpiece must remain engaged with one or the other of the needles until it is finished and "cast off" with a binding row.

The number of stitches that can fit on a needle is limited by the length of the needle. To make wider panels of fabric using standard knitting needles, the knitter must use longer needles or create multiple panels that are later joined together. Both approaches have drawbacks. Creating a piece from multiple panels is cumbersome and may not result in the same look and feel as a continuously knitted piece. Longer needles have more weight and thus, can cause greater fatigue. Also, longer needles are more likely to break, particularly if light weight material is used. At some point, the length of the needles becomes impractical.

Wider workpieces can also be formed on so-called circular needles. Circular needles are formed by connecting the ends of two needles together by a cable. Using such needles is referred to as "knitting in the round." Stitches at the leading edge of the workpiece remain engaged with the cable as they are created. The knitter knits continuously in one direction so that the stitches form a tubular workpiece.

There are a number of problems with circular needles used to knit in the round. Many users find "knitting in the round" uncomfortable because the weight of the workpiece is borne by the cable supported by the knitter's hands holding the needles. The weight of the workpiece on the ends of the needles opposite the tip must be lifted each time the knitter moves the tip up and down. This can cause fatigue and discomfort, particularly when the knitter lacks hand and arm strength due to age or to disease, such as arthritis, carpal tunnel syndrome, and the like.

Knitting in the round also makes it difficult for the knitter to see the layout of the workpiece while knitting. To create patterns of texture or color in a knitted piece, the knitter may need to see the entire piece laid out flat and may need to make decisions about the type of stitch or color of yarn to use. This may be difficult when the piece is held on a loop of cable.

To create a new stitch linked to a previously formed stitch, the knitter brings the previously formed stitch to the tip of the needle, links that stitch with a loop of yarn forming the new stitch, and transfers the new stitch to the other needle. This is repeated, one stitch after another as the knitter progresses along the row of previously formed stitches. For a workpiece on circular needles, the knitter must repeatedly slide stitches from the cable onto the needle so they can be delivered to the needle tip. To keep the workpiece in a comfortable position to form the next stitch, the knitter must constantly pull stitches from the cable onto the needle. This can cause fatigue.

SUMMARY

The present disclosure relates to apparatuses and methods to address these difficulties.

One aspect of the disclosure describes a knitting needle that includes a cord or cable to hold stitches of the workpiece. The cable has an adjustable stop or slider that can be moved along the cable to a selected distance from the needle. The distance is adjusted to accommodate the number of stitches required for a workpiece of a desired width and to position that workpiece in a desired relationship to the tip of the needle. Another aspect of the disclosure describes a slider mechanism disposed on the cable that the knitter can conveniently adjust to change the distance between the needle and the slider to reposition the workpiece along the cable relative to the needle. The knitter may reposition the slider a number of times when forming each row of stitches. The slider may be formed from materials that reduce wear on the cable as the slider is moved or improve the grip of the slider on the cable to more securely hold the slider in place.

A further aspect of the disclosure describes a knitting needle, cable, adjustable slider, and a connection mechanism that allows the adjustable cable to be removably connected with the needle. According to this aspect, a variety of needles and cables can be connected with one another to create a desired combination of features.

Another aspect of the disclosure describes a method of knitting. The knitter uses a first needle comprising a cable, an adjustable slider, and an end stopper that prohibits the slider from moving off the end of the cable. The slider forms a stop that prevents stitches from sliding along the cable so that stitches are captive between the slider and the knitter's hand holding the needle. The knitter adjusts the distance between the slider and the needle so that the stitches are compressed toward the needle. The resiliency of the stitches urges them along the cable and toward the tip of the needle. The knitter holds stitches on the needle so that they remain in place. The knitter moves stitches, one at a time, toward the tip of the needle to knit. The resilient force urges stitches along the cable so that the knitter can easily deliver them to the tip of the needle.

According to another aspect of the disclosure, the knitter uses a second needle, also comprising a cable and adjustable slider, in combination with the first needle to form a new row of stitches interlocked with the previously formed row. The distance of the slider along the cable of the second needle is adjusted to hold a number of stitches sufficient to form the desired width of the workpiece without compression. The knitter puts newly created stitches onto the second needle as they are interlocked and allows them to slide along the second needle and its cable. Because the distance between the needle and slider is adjusted to hold the width of the workpiece, the newly created stitches can be placed on the second needle without having to compress them.

According to a further aspect of the disclosure there is provided a knitting needle assemble comprising a first needle body having first and second ends, wherein the first end forms a needle tip, a flexible cord connected at a first end to the second end of the needle, and an adjustable stop disposed on the cord, wherein the stop can be adjustably fixed to a selected point along the length at the cord. The adjustable stop may comprise a slider and where the cord extends through a passage of the slider. The assembly may comprise a fixed stop disposed at a second end of the cord opposite the first end connect with the needle body, wherein the fixed stop is configured to prevent the slider from moving off the end of the cord. The cord may be formed from one or more of a metal wire, a polymer, a woven fabric, and a combination thereof and may include a friction-reducing or wear-reducing coating. The first needle body may be formed from one or more of hardwood, including rosewood, sheesham, or ebony; bamboo; polymer; metal or metal alloy, including aluminum, steel, brass, bronze, copper, gold, silver; and/or combinations thereof. The first needle body may comprise two sections along its length, the sections set at a non-zero angle to one another.

According to a further aspect of the disclosure the assembly includes a transition portion that connects the second end of the needle body with the first end of the cord where the transition portion has a smooth variation in diameter between a diameter of the needle body and a diameter of the cord.

According to a further aspect of the disclosure the assembly further comprises a second needle body, wherein the first and second needles bodies are shaped to allow a user to knit a fabric. The first needle body, cord, and adjustable stop may comprise a first needle assembly and the assembly may comprise a second needle assembly including the second needle body, a second cord attached thereto, and a second adjustable stop disposed on the second cord.

According to a further aspect of the disclosure there is provided a method of knitting fabric. The method may include the steps of positioning a plurality of stitches on the first needle body and the cord attached thereto, adjusting a position of the adjustable stop of the first needle assembly such that the plurality of stitches are compressed between the needle body and the adjustable stop of the first needle assembly, wherein the compressed stitches create a resiliency force, moving a first stitch of the plurality of stitches to the tip of the needle body of the first needle assembly, interlocking the first stitch with a newly formed stitch using tips of needle bodies of the first and second assemblies, placing the newly formed stitch on the second needle body, and delivering second stitches of the plurality of stitches to the needle body of the first assembly using the resiliency force. The method may further comprise adjusting a position of the second adjustable stop on the second cord so that the distance from a tip of the second needle body to the second adjustable stop is sufficient to hold the plurality of stitches.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
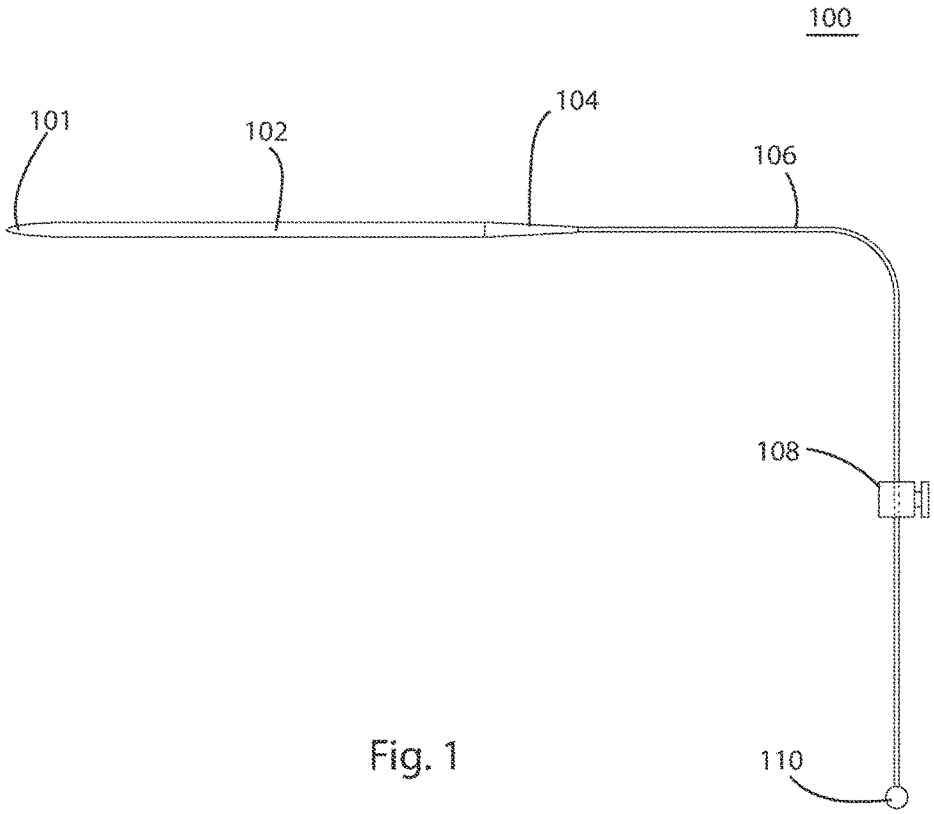
FIG. 1 shows a knitting needle assembly according to an embodiment of the disclosure.

FIG. 1 shows a knitting needle assembly 100 according to an embodiment of the disclosure. A knitting needle 102 is connected with a cord 106 by a transition portion 104. At the end of the cord opposite the needle is a stopper 110. A moveable slide 108 is positioned on the cord 106. Typically, two such assemblies are used by a knitter to form a knitted workpiece from interlocking stitches.

The needle 102 may be formed from any of a variety of materials and is preferably light in weight. Exemplary materials including hardwood such as rosewood, sheesham, or ebony, bamboo, polymer, metal or metal alloy, such as aluminum, steel, brass, bronze, copper, gold, silver, and/or combinations thereof. The surface of the needle 102 is preferable smooth to facilitate sliding of stitches across its surface. The needle has a tip 101 at the end opposite the transition portion 104 with a shape suitable for forming interlinked stitches of yarn.

The transition portion 104 provides a smooth surface between the needle 102 and the cord 106 over which stitches of yarn can slide as the needle assembly is used to knit. In this exemplary embodiment, the transition portion 104 has a frustoconical shape with the end connected with the needle 102 equal to the needle diameter and the end connected with the cord 106 equal to the cord diameter. Other shapes are also possible, including providing cylindrical portions equal to the needle and cord diameters, respectively, and a frustoconical portion between the cylindrical portions. According to another embodiment, the transition portion 104 is omitted and the cord 106 is connected directly with the needle 102.

The transition portion 104 may be formed from the same material as the needle 102 or may be formed from a different material and joined to the needle 102. According to one embodiment, the transition portion 104 is formed from a metal or metal alloy such as steel, brass, bronze, copper, gold, silver, a polymer, an elastomer, a composite material, and/or a combination of these.

Cord 106 is flexible and has a smooth surface to facilitate sliding of stitches of yarn along its length. According to one embodiment cord 106 is between about 12 inches and 60 inches long. According to a preferred embodiment, cord 106 is between about 24 inches and 48 inches long. According to a most preferred embodiment, cord 106 is about 36 inches long. Cord 106 may be formed from a plastic, a metal, a natural fiber, a composite material, or a combination thereof. Cord 106 may be a single filament or may be woven from strands of material or may be a formed from twisted or braided strands, metal wire, or combination thereof. According to a further embodiment, the cord includes a coating that reduces friction with the yarn and/or that resists wear.

According to one embodiment, cord 106 has a round cross section. According to another embodiment, cord 106 is formed as a flat strip of material. Cord 106 may have a curl so that it tends to form a curled-up configuration when not forced into a straight configuration. By providing a curl, cord 106 can be made to more easily assume a compact configuration when not in use. Cord 106 may include markings along its length, such as inch or centimeter markings or markings that correspond to a number of stitches forming a workpiece. Such markings may be useful during use to allow the knitter to easily measure the width of the workpiece as it is being formed or to determine a pattern of colors or stitch textures to use.

According to one embodiment, the cord can rotate with respect to the needle. This reduces twisting of the cord and eases knitting. The rotatable connection can be formed by swivel mechanism comprising part of the transition portion, by a rotatable connection, such as a ball-in-socket arrangement, between the cord and the transition portion or between the transition portion and the needle, or a combination thereof.

Figure 2A:
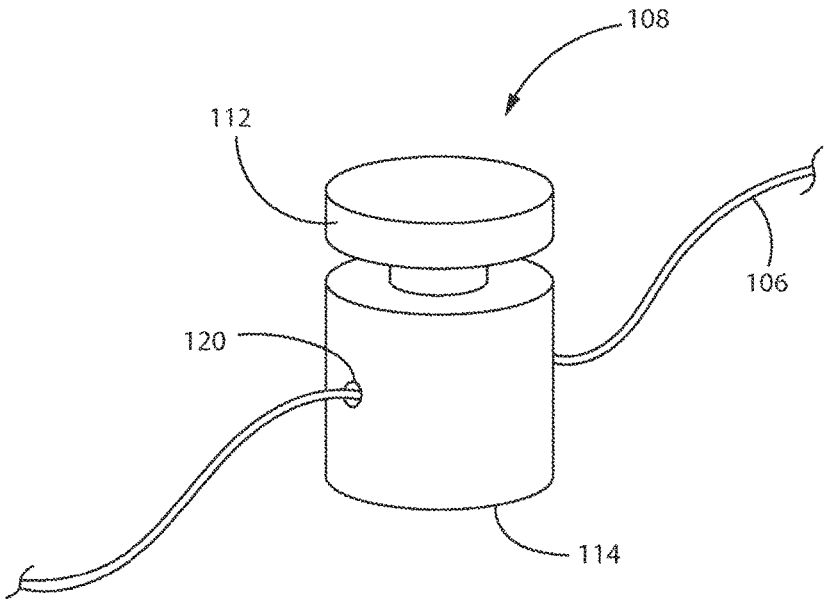
FIGS. 2*a-c* show a slider according to an embodiment of the disclosure.
Figure 2B:
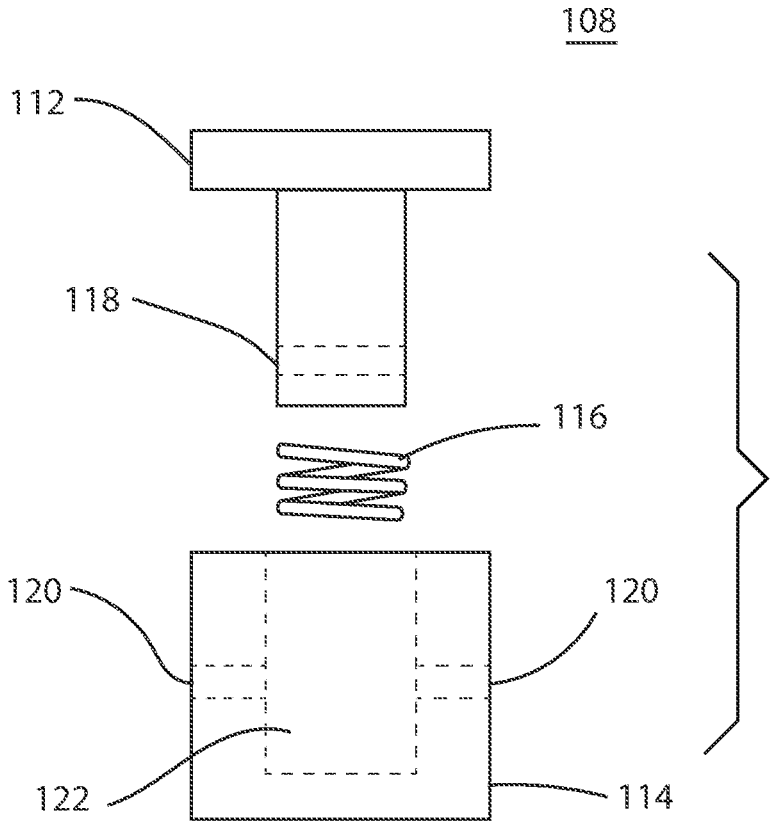
Figure 2C:
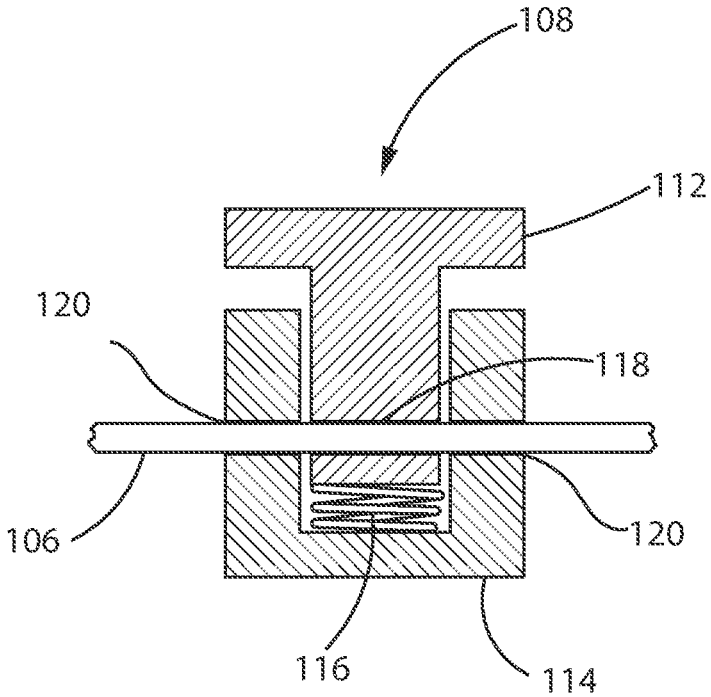

Slider 108 is disposed on the cord 106. FIGS. 2*a-c* show a slider according to one embodiment of the disclosure. FIG. 2*a* shows a perspective view the slider 108 disposed on cord 106. FIG. 2*b* shows the slider before assembly. FIG. 2*c* shows a cross section of the assembled slider 108 disposed on cord 106. As shown in FIG. 2*b*, the slider 108 consists of a button portion 112, a receiver portion 114, and a spring 116. A through-hole 118 extends through the button 112. Through-holes 120 are provided through opposing sides of the receiver 114. As shown in FIG. 2*c*, when the slider 108 is assembled, cord 106 extends through holes 118, 120. The inner diameter of holes 118, 120 is somewhat larger than the outer diameter of cord 106 so that, when holes 118, 120 are aligned, cord 106 moves easily through the holes. Spring 116 provides a force pushing button 112 out of cavity 122. This force causes holes 118, 120 to tend to misalign, thus engaging with and fixing the slider 108 to the cord 106 at a desired location along the cord. Pressing button 112 toward receiver 114 compresses spring 116 and causes holes 118, 120 to align, thus unlocking slider 108 from cord 106. When the slider 108 is unlocked, it can be repositioned along the length of cord 106.

According to one embodiment, slider 108 is cylindrical. According to another embodiment, slider 108 is square, rectangular, oval, or other shape. Button 112 and receiver 114 may be formed from hardwood, metal, plastic, composite materials, or a combination thereof. According to a further embodiment, the slider may be a different mechanism suitable for releasably fixing to the cord such as a screw clamp or spring loaded clip.

As shown in FIG. 1, stopper 110 is affixed to the end of cord 106. Stopper 110 is larger than the diameter of hole 120 in the slider 108 and prevents the slider from moving off the end of cord 106. Stopper 110 may be a knot formed in the end of cord 106. Stopper 110 may also be an object such as a ball or a decorative item such as a crystal. Stopper 110 may include an embossable surface to allow a trademark, a logo, or personalized information, such as a monogram to be displayed. Stopper 110 may include a tool, such as a yarn cutter, scissors, row or stitch counter, and the like.

According to one embodiment, stopper 110 includes a clip, magnetic catch, or other engagement mechanism designed to securely and removably connect the stopper 110 with the needle 102 or transition portion 104. By engaging the engagement mechanism with the other portion of the assembly, the cord 106 is formed into a closed loop. A partially finished workpiece can be securely retained, stored, and transported with the cord in such a loop configuration. According to another embodiment, the engagement mechanism is disposed on the slider 108, again forming the cord 106 into a closed loop to securely retain a partially finished workpiece. According to a further embodiment, the stopper 110 or slider 106 comprises a needle cap that securely and removably engages with the tip of the needle.

Figure 3:
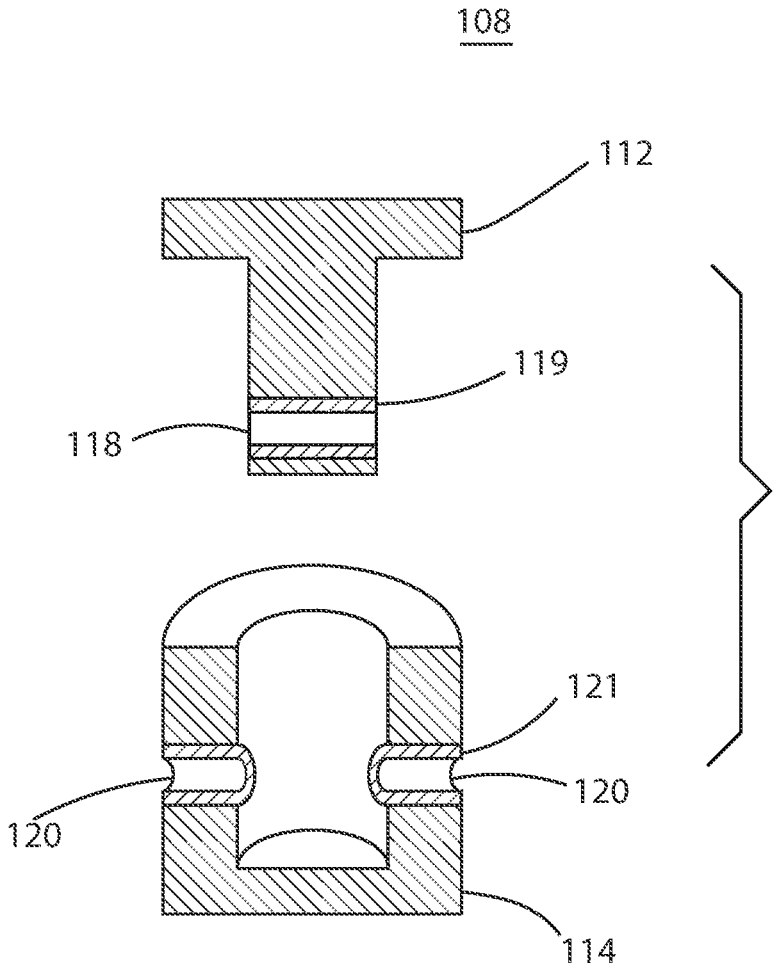
FIG. 3 shows a slider according to a further embodiment of the disclosure.

FIG. 3 shows cross section views of the button 112 and receiver 114 according to an alternative embodiment of the slider 108. As with the embodiment described above, the button portion 112 and a receiver portion 114 have through-holes 118 and 120 for engaging cord 106. Surrounding the through-hole in the button 112 is a liner 119. The through-holes 120 in receiver 114 are likewise surrounded by a liner 121. The liner 119, 121 may be formed from an elastomer, such as silicone rubber, natural rubber, polyurethane, and the like that provides a high-friction contact with the surface of the cord 106 and/or that reduces wear or damage to the cord 106 as the slider is moved along the cord 106.

Top and bottom surfaces of the button 112 and receiver 114 may also include features that improve grip. These features may include grooves or textured surfaces or coatings such as non-slip coatings that allow the knitter to securely hold the slider while repositioning it along the cord. The top and/or bottom surfaces of the button 112 and receiver 114, respectively, may also be concave to allow the knitter to securely hold and operate the slider.

Figure 4A:
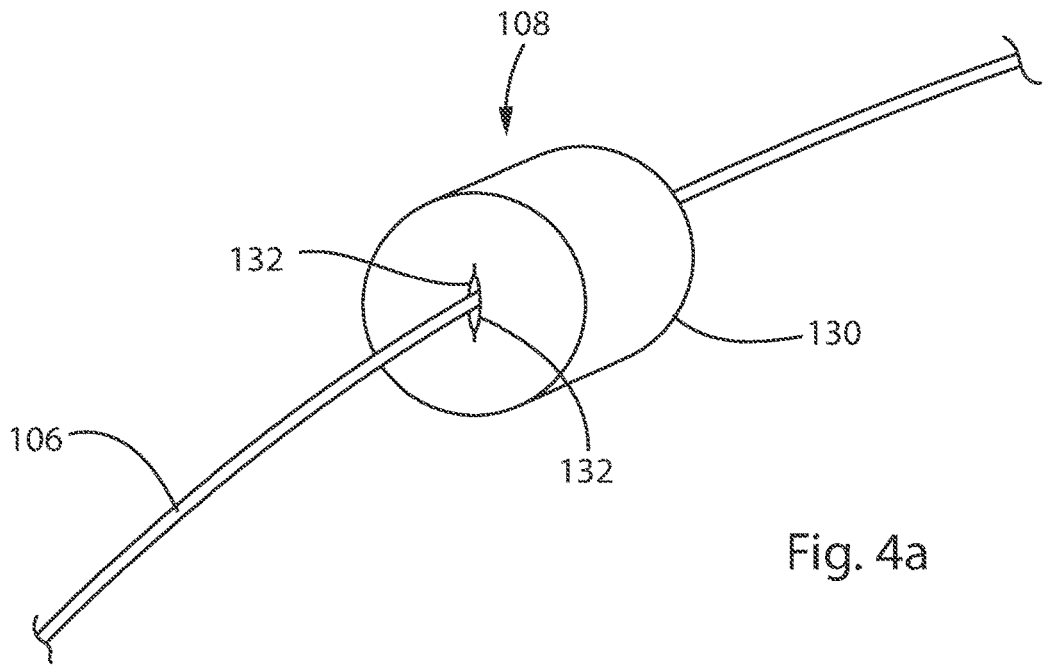
FIGS. 4*a-b* show a slider according to a still further embodiment of the disclosure.
Figure 4B:
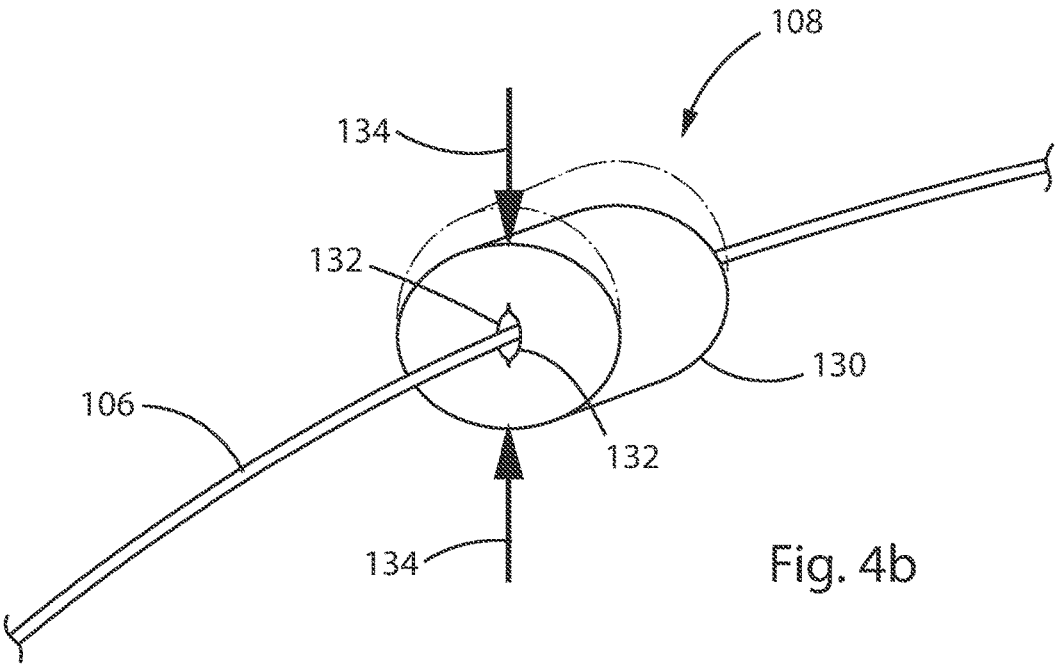

FIGS. 4*a* and 4*b* show another embodiment of a slider 108. According to this embodiment, slider 108 is formed from an elastomeric material such as polyurethane or silicone rubber. The slider body 130 includes an opening 132 extending through the length of the slider 108. Cord 106 extends through the opening 132. The opening 132 has a lens-shaped cross section. As shown in FIG. 4*a*, when no force is applied to the body 130, the sides of the opening 132 press against the cord 106, holding the slider 108 in place on the cord. As shown in FIG. 4*b*, when force is applied in the directions shown by arrows 134, the body 103 deforms, causing the lens-shaped opening 132 to expand away from the surface of cord 106. In this configuration, slider 108 can be repositioned along cord 106. When the force is release, body 130 rebounds to the configuration shown in FIG. 4*a*, again fixing the slider to the cord.

According to one embodiment, both stopper 110 and transition portion 104 are larger than holes 120 of the slider. Stopper 110 is permanently affixed to cord 106. When needle assembly 100 is assembled as shown in FIG. 1, slider 108 cannot slide past stopper 110 and transition portion 104 and is captive on cord 106. This arrangement prevents the slider 108 from becoming separated from the assembly 100 and misplaced. According to another embodiment, stopper 110 is removable from cord 106, allowing the slider 108 to be removed from the cord 106. According to this embodiment, the slider 108 can be replaced with a different slider.

The needle 102, transition portion 104, slider 108 and/or stopper 110 may include a surface suitable for holding markings such as a product logo, needle size information, and the like.

Figure 5:
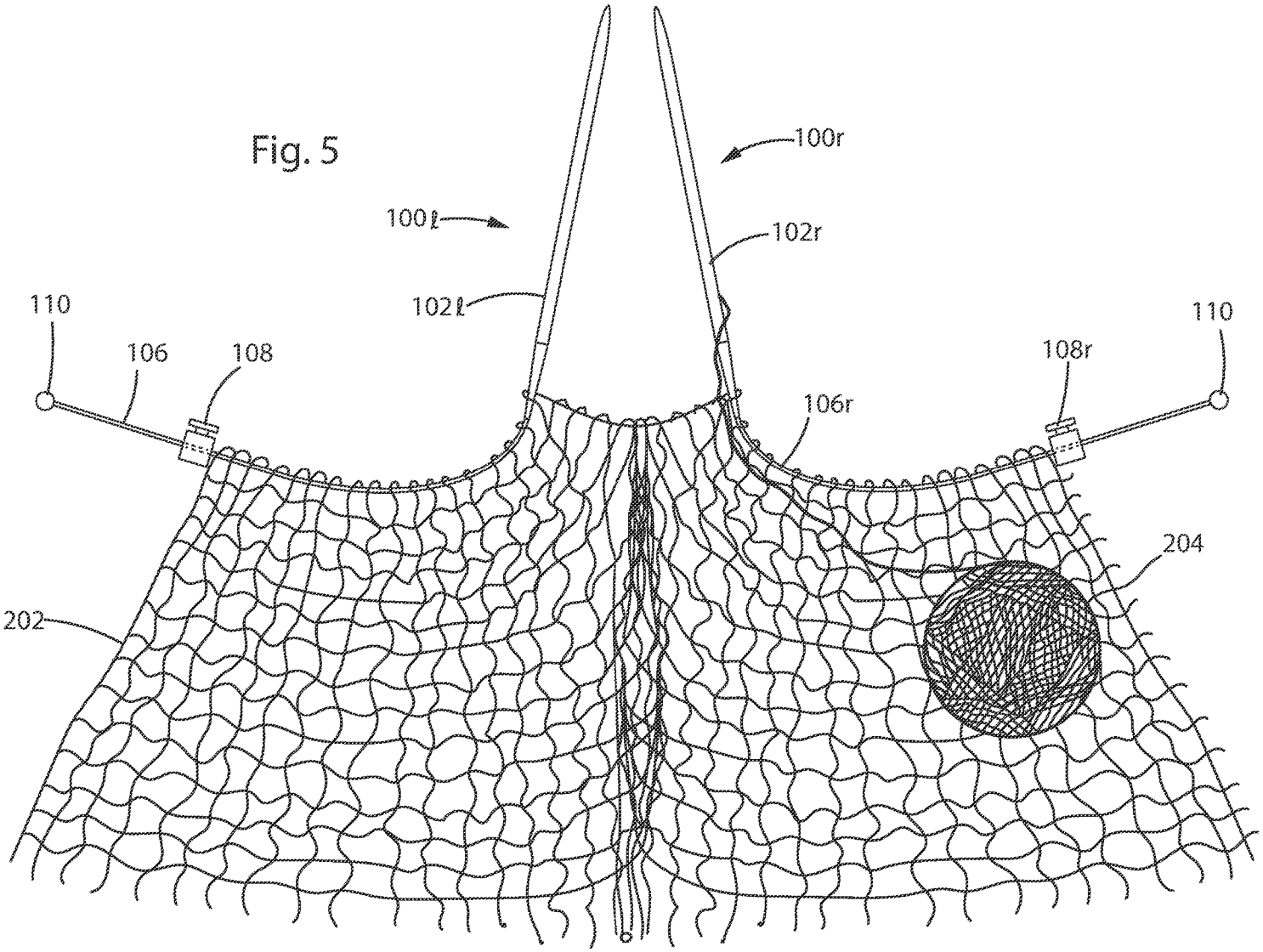
FIG. 5 show two knitting needle assemblies according to an embodiment of the disclosure used to form a knitted workpiece.

FIG. 5 shows two needle assemblies 100*l*, 100*r* used to form a workpiece 202. The knitter manipulates needles 102*l*, 102*r* to form interlocking stitches of yarn 204. If the knitter is knitting to the left as shown in FIG. 5, the knitter moves a previously formed stitch to the tip of left needle 102*l* and uses the tips of the left and right needles to form a new stitch that is moved onto right needle 102*r*. The process is repeated, with newly stitches sliding along right needle 100*r* and along cord 106*r*. The position of slider 108*r* on cord 106*r* may be selected to accommodate the desired width of the workpiece.

The needle assembly of the present disclosure allows shorter needles to be used, regardless of the size of the workpiece because the workpiece is supported and retained on the cord. This arrangement is especially useful in the knitting of large garments, such as blankets and afghans where standard straight needles are generally too short to hold the amount of stitches needed. According to one embodiment, cords 106*l* and 106*r* can rest on a tabletop or in the knitters lap to support the weight of the workpiece and relieve strain on the knitter's hands. This is advantageous for knitting heavy, bulky or large items.

When stitches encounter slider 106*r* they stop moving along the cord and accumulate on the cord. The position of slider 106*r* is selected so that the required number of stitches needed to form the width of the workpiece 202 can accumulate on cord 106*r* without interfering with the knitter's manipulation of the needles.

A method of knitting according to one embodiment of the disclosure adjustable sliders 108*l* and 108*r* allow the knitter to conveniently deliver previously formed stitches to the tips of needles 102*l* and 102*r*. Again, assuming the knitter is knitting to the left as shown in FIG. 5, stitches are taken from left needle 102*l*, joined with newly formed stitches by manipulating the yarn with needles 102*l* and 102*r*, and transferred to right needle 102*r*. The newly formed stitches slide along needle 102*r* and onto cord 106*r*, as described above. As previously formed stitches are being removed from left assembly 100*l*, the knitter moves left slider 108*l* toward left needle 102*l* while holding a grip on previously formed stitches on left needle 102*l*. This pushes previously formed stitches toward the knitters left hand, compressing the stitches against one another and biasing them to move toward the tip of the left needle 102*l*. The knitter can then conveniently deliver stitches from left needle 102*l* to the tip of the needle for knitting. As previously formed stitches on the left needle are knitted to newly formed stitches and transferred to the right needle, the resilience of the stitches compressed between the knitter's left hand and the slider 108*l* causes more stitches to move to the right from cord 106*l* and onto the needle 106*l*. The knitter does not have to continually move stitches from the bottom of the cord to the needle. Periodically, as previously formed stitches are knitted and transferred from the left needle 102*l* the knitter repositions slider 108*l* to maintain compression on the previously formed stitches.

With an embodiment of the present invention, by pulling slider 108*l* closer to needle 102*l*, the resilience of the stitches causes a force pushing the stitches toward the needle tip. The knitter can then control the delivery of previously formed stitches by allowing the stitches to slide toward the needle tip. Also, when the knitter is knitting to the left as shown in FIG. 5, right slider 108*r* can be moved farther out along cord 106*r* so that newly formed stitches are not compressed, but instead, move easily away from the knitter's right hand. Once a row knitted to the left is complete, the knitter can adjust sliders 108*l*, 108*r* to reverse the process, this time compressing stitches on right assembly 100*r* so that they are delivered to the tip of right needle 102*r* and slide without interference onto cord 106*l* of left assembly 100*l*.

Figure 6:
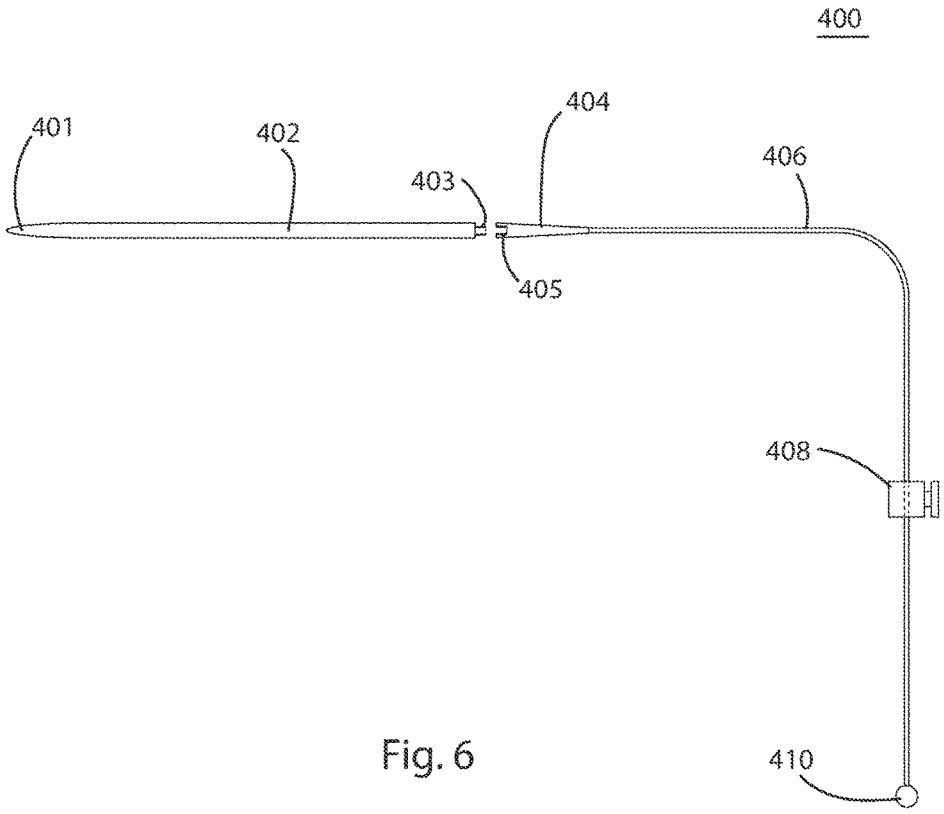
FIG. 6 shows a knitting needle assembly according to a further embodiment of the disclosure.

FIG. 6 shows another embodiment according to the disclosure. Assembly 400 is formed from needle 402 including threaded portion 403 at the end opposite the tip 401. Transition portion 404 includes threaded hole 405. Needle 402 is connected with transition portion 404 by threading threaded portion 403 into hole 405. Cord 406, slider 408, and stopper 410 are similar to the cord, slider and stopper described above with respect to FIG. 1. Needle 402 can be disconnected from transition portion 404 by disconnecting the threaded portions and connected with the transition portion 404 of a different assembly. This allows a variety of needles 402 to be interchangeably connected with the same cord 406, slider 408, and stopper 410 assembly. According to another embodiment, instead of a threaded connection between needle 402 and transition portion 404, these elements can be removably connected with one another using a friction fit, a snap, a twist lock, or other removable connection mechanism.

According to a further embodiment of the disclosure, the components of assembly 400 are provided as part of a kit. The kit may include a plurality of needles 402 that can be interchangeably connected with a transition portion 404, cord 406, slider 408, and stopper 410. The plurality of needles 402 may have differing diameters, lengths, and/or cross sectional shapes that are appropriate for a variety of knitting projects. For example, the kit may include needles with sizes US# 11, 13, 15, 19, but is not limited to those sizes. The kit may also include a plurality of cord and slider assemblies of differing lengths to allow a knitter to select a cord with a length appropriate for a particular project. The kit may also include other materials, including instruction manuals, media containing instructional diagrams or video tutorials demonstrating the use of the assembly, patterns for projects, yarns, and/or other accessories.

Figure 7:
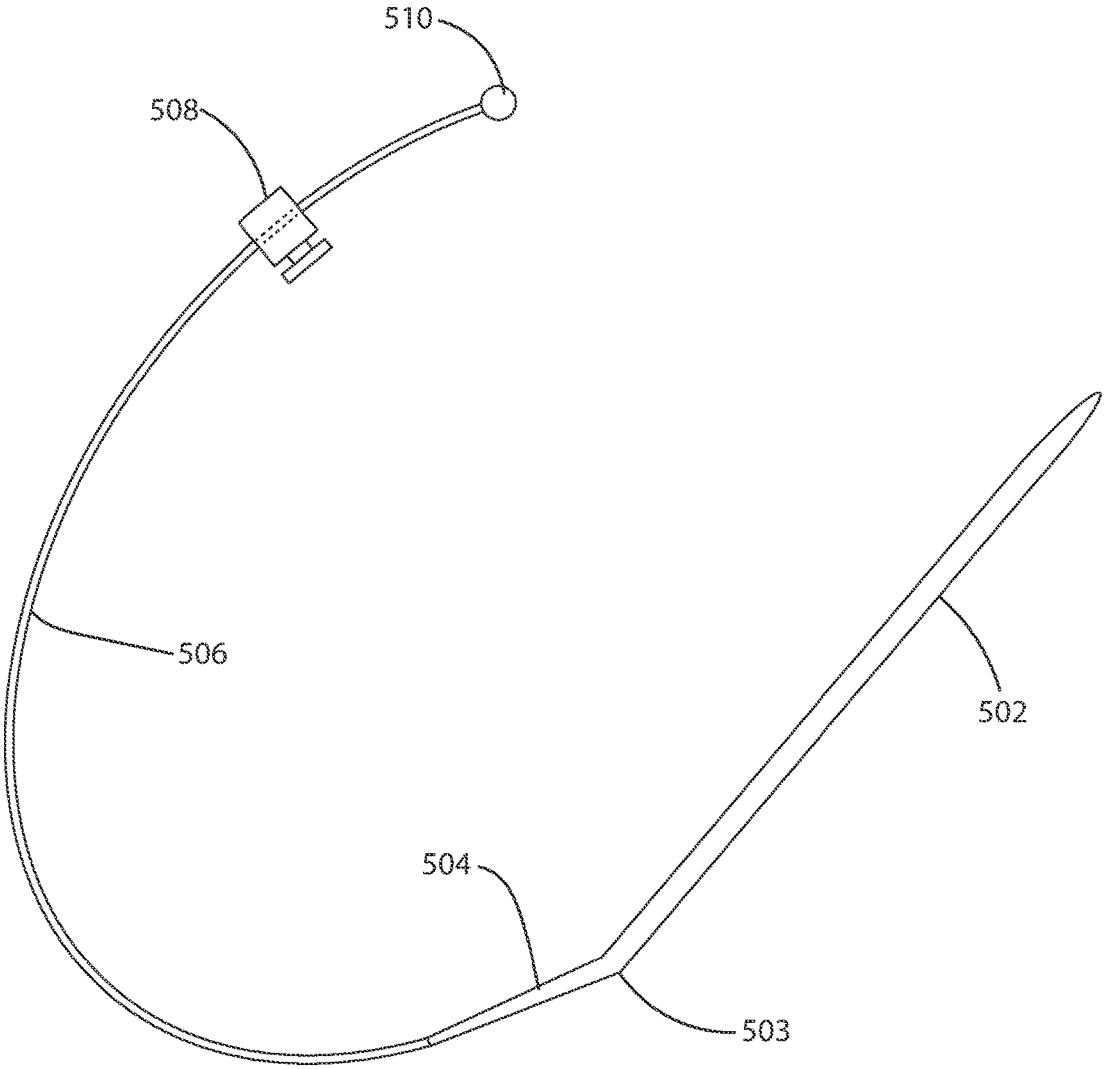
FIG. 7 shows a knitting needle assembly according to a still further embodiment of the disclosure.

FIG. 7 shows a further embodiment according to the disclosure. Needle 502 includes an angled portion 503. Cord 506, slider 508, and stopper 510 are similar to the cord, slider and stopper described above.

While illustrative embodiments of the disclosure have been described and illustrated above, it should be understood that these are exemplary of the disclosure and are not to be considered as limiting. Additions, deletions, substitutions, and other modifications can be made without departing from the spirit or scope of the disclosure. Accordingly, the disclosure is not to be considered as limited by the foregoing description.

I claim:

1. A knitting needle assembly comprising:

a first needle body having first and second ends, wherein the first end forms a needle tip;

a flexible cord connected at a first end to the second end of the needle; and an adjustable stop disposed on the cord comprising a spring mechanism that, in an uncompressed configuration fixes the stop to a first selected point along the length of the cord, wherein compression of the spring mechanism permits the stop to be movable to a second selected point along the length of the cord.

2. The assembly of claim 1, wherein the stop further comprises a receiver portion forming a cavity surrounded by one or more walls, wherein the one or more walls comprise a pair of through-holes forming a passage through the receiver portion, wherein the cord extends through the passage via the pair of through-holes, and wherein the pair of through-holes are disposed on the one or more walls directly opposite each other such that the pair of through-holes are in alignment.

3. The assembly of claim 1, further comprising a fixed stop disposed at a second end of the cord opposite the first end connected with the needle body, wherein the fixed stop is configured to prevent the adjustable stop from moving off the end of the cord.

4. The assembly of claim 1, further comprising a transition portion, wherein the transition portion rotatably connects the second end of the needle body with the first end of the cord to allow the cord to rotate with respect to the needle body and wherein the transition portion has a smooth variation in diameter between a diameter of the needle body and a diameter of the cord.

5. The assembly of claim 1, further comprising a second needle body, wherein the first and second needles bodies are shaped to allow a user to knit a fabric.

6. The assembly of claim 5, wherein the first needle body, cord, and adjustable stop comprise a first needle assembly and further comprising a second needle assembly, the second needle assembly comprising the second needle body, a second cord attached thereto, and a second adjustable stop disposed on the second cord.

7. The assembly of claim 1, wherein the cord is formed from one or more of a metal wire, a polymer, a woven fabric, and a combination thereof.

8. The assembly of claim 1, wherein the cord comprises a friction-reducing or wear-reducing coating.

9. The assembly of claim 1, wherein the first needle body is formed from one or more of hardwood, including rosewood, sheesham, or ebony; bamboo; polymer; metal or metal alloy, including aluminum, steel, brass, bronze, copper, gold, silver; and/or combinations thereof.

10. The assembly of claim 1, wherein the first needle body comprises two sections along its length, the sections set at a non-zero angle to one another.

11. A method of knitting fabric using a knitting needle assembly comprising: a first needle assembly comprising: a first needle body having first and second ends, wherein the first end forms a needle tip; a first flexible cord connected at a first end to the second end of the first needle; and a first adjustable stop disposed on the first cord, wherein the first stop can be adjustably fixed to a selected point along the length of the first cord; and a second needle assembly comprising: a second needle body, wherein the first and second needles bodies are shaped to allow a user to knit a fabric; a second flexible cord attached to the second needle body; and a second adjustable stop disposed on the second cord, the method comprising the steps of:

positioning a plurality of stitches on the first needle body and the cord attached thereto;

adjusting a position of the adjustable stop of the first needle assembly such that the plurality of stitches are compressed between the needle body and the adjustable stop of the first needle assembly, wherein the compressed stitches create a resiliency force;

moving a first stitch of the plurality of stitches to the tip of the needle body of the first needle assembly;

interlocking the first stitch with a newly formed stitch using tips of needle bodies of the first and second assemblies;

placing the newly formed stitch on the second needle body; and delivering second stitches of the plurality of stitches to the needle body of the first assembly using the resiliency force.

12. The method according to claim 11, further comprising the step of:

adjusting a position of the second adjustable stop on the second cord so that the distance from a tip of the second needle body to the second adjustable stop is sufficient to hold the plurality of stitches.

13. A knitting needle assembly comprising:

a first needle body having a first end forming a needle tip and a second end;

a flexible cord having a first end connected to the second end of the needle; and an adjustable stop movably disposed on the cord including an elastic body, wherein when the elastic body is in an uncompressed configuration the adjustable stop is fixed to a first selected point along the length of the cord, and wherein when the elastic body is compressed the elastic body permits the adjustable stop to be movable to a second selected point along the length of the cord.

14. The assembly of claim 13, wherein the elastic body comprises a pair of openings disposed directly opposite each other such that the pair of openings are in alignment so as to permit the cord to extend through the elastic body via the pair of openings.

15. The assembly of claim of claim 14, wherein each of the pair of openings has a lens-shaped cross-section such that sides of the pair of lens-shaped openings press against the cord in the uncompressed configuration thereby fixing the stop to the first selected point.

16. The assembly of claim 15, wherein, when force is applied to the elastic body in a direction that causes the sides of the pair of lens-shaped openings to expand away from the cord, the cord is released from the pressure of the sides of the pair of lens-shaped openings thereby permitting the adjustable stop to be movable to the second selected point.

17. The assembly of claim 2, wherein the spring mechanism includes a button portion having a further through-hole to form a further passage in the button portion, wherein the cord extends through the further passage via the further through-hole.

18. The assembly of claim 17, wherein the cord extends through the passage of the receiver portion via the pair of through-holes of the receiver portion and through the further passage of the button portion via the further through-hole of the button portion.

19. The assembly of claim 18, wherein the spring mechanism includes a spring having a first end adjacent to the button portion and a second end adjacent to a bottom of the cavity, wherein the spring urges the pair of through-holes of the receiver portion to be misaligned with the further through-hole of the button portion so as to fix the stop to the first selected point, and wherein force applied to the button portion causes the spring to compress and the pair of through-holes of the receiver portion to align with the further through-hole of the button portion thereby permitting the stop to be movable to the second selected point.

20. The assembly of claim 17, wherein the further through-hole of the button portion and the pair of through-holes of the receiver portion each comprise a liner and wherein the liner provides at least one of a high-friction contact with a surface of the cord and a reduction of wear or damage to the cord as the adjustable stop is moved along the length of the cord.

* * * * *